US010596821B2

(12) United States Patent
Haines et al.

(10) Patent No.: US 10,596,821 B2
(45) Date of Patent: Mar. 24, 2020

(54) ROCKER VALVE

(71) Applicant: HEWLETT-PACKARD DEVELOPMENT COMPANY, L.P., Houston, TX (US)

(72) Inventors: Paul Mark Haines, Corvallis, OR (US); Mark A. Devries, Corvallis, OR (US); John L. Taylor, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/092,849

(22) PCT Filed: Apr. 21, 2016

(86) PCT No.: PCT/US2016/028695

§ 371 (c)(1),
(2) Date: Oct. 11, 2018

(87) PCT Pub. No.: WO2017/184156

PCT Pub. Date: Oct. 26, 2017

(65) Prior Publication Data

US 2019/0202208 A1 Jul. 4, 2019

(51) Int. Cl.
*B41J 2/175* (2006.01)
*B41J 29/38* (2006.01)

(52) U.S. Cl.
CPC ..... *B41J 2/17596* (2013.01); *B41J 2/175* (2013.01); *B41J 29/38* (2013.01)

(58) Field of Classification Search
CPC ..... B42J 2/17596; B42J 2/175; B42J 29/38
See application file for complete search history.

(56) References Cited

U.S. PATENT DOCUMENTS

| | | | |
|---|---|---|---|
| 6,341,853 | B1 | 1/2002 | Scheffelin |
| 6,739,710 | B2 | 5/2004 | Lin |
| 7,544,431 | B2 | 6/2009 | DeVos |
| 8,360,552 | B2 | 1/2013 | Justice |
| 2001/0006395 | A1 | 7/2001 | Pawlowski |

(Continued)

FOREIGN PATENT DOCUMENTS

| | | |
|---|---|---|
| EP | 1093922 | 4/2001 |
| EP | 1223039 | 7/2002 |

(Continued)

OTHER PUBLICATIONS

Hirata, et al; "An Ink-jet Head Using Diaphragm Microactuator"; Feb. 11-15, 1996; Precision Technology Development Center; Sharp Corporation—Japan.

*Primary Examiner* — Jason S Uhlenhake
(74) *Attorney, Agent, or Firm* — Fabian VanCott

(57) ABSTRACT

A rocker valve includes a number of rails to transitionally connect an arm of a spring to the rocker valve such that the arm of the spring transitions across the rocker valve to actuate the rocker valve, a first side of the rocker valve to selectively engage with a valve seat based on a position of the arm of the spring relative to the first side of the rocker valve, and a number of pivot arms to pivot the rocker valve between a closed position and an open position such that the first side of the rocker valve selectively engages with the valve seat to regulate pressure inside a print head assembly.

20 Claims, 12 Drawing Sheets

(56) References Cited

U.S. PATENT DOCUMENTS

| | | | | |
|---|---|---|---|---|
| 2002/0191061 | A1 | 12/2002 | Dowell | |
| 2007/0139488 | A1* | 6/2007 | Fujishiro | B41J 2/17513 347/72 |
| 2011/0310194 | A1 | 12/2011 | Takagi | |
| 2012/0044284 | A1* | 2/2012 | Katoh | B41J 2/175 347/6 |

FOREIGN PATENT DOCUMENTS

| | | |
|---|---|---|
| EP | 1524119 | 8/2009 |
| JP | 2012035425 | 2/2012 |

* cited by examiner

ROCKER VALVE

BACKGROUND

Printers provide a user with a hard copy of a document. A print head assembly is used to eject printing fluid or other printable material onto a print medium via a number of nozzles to form an image or text. In some examples, a carriage moves along a rod via a motor to position the print head assembly to selectively eject the printing fluid onto the print medium to form an image or text.

BRIEF DESCRIPTION OF THE DRAWINGS

The accompanying drawings illustrate various examples of the principles described herein and are a part of the specification. The examples do not limit the scope of the claims.

Throughout the drawings, identical reference numbers designate similar, but not necessarily identical, elements.

DETAILED DESCRIPTION

Figure 1:
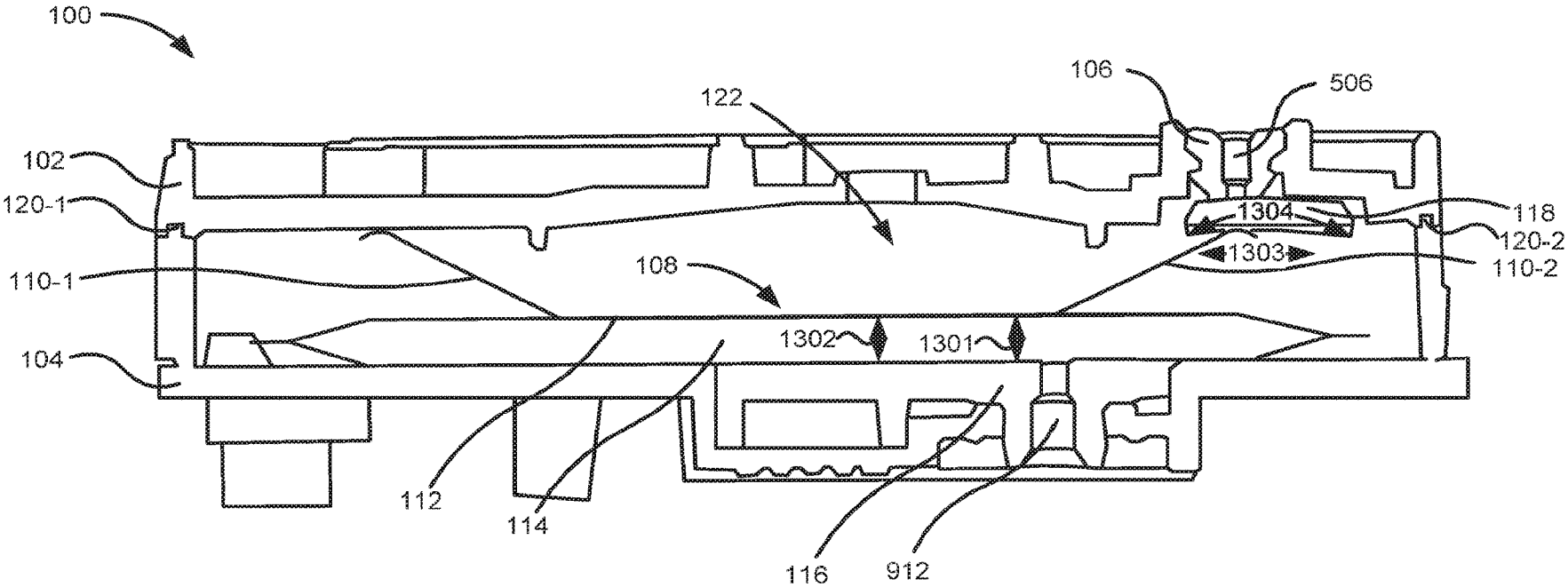
FIG. 1 is a cutaway side view of a system for regulating pressure in a print head assembly, according to one example of principles described herein.

A print head assembly is used to eject printing fluid or other printable material onto a print medium via a number of nozzles to form an image or text. The print head assembly includes a fluid chamber to retain printing fluid inside of the print head assembly and to supply the printing fluid to nozzles. The nozzles of the print head assembly selectively eject drops of the printing fluid onto the print medium to form an image or text. As noted, in some examples, a carriage moves the print head assembly relative to the print medium such that the printing fluid ejected by the print head assembly can be properly placed on the print medium to form the image. The carriage is moved relative to the print medium by a motor and is guided by a rod. In other examples, the print head assembly spans an entire printable width of the print medium such that the print head assembly does not move, but still ejects printing fluid or other printable material onto the print medium to form an image or text.

While such a system is useful in depositing the printing fluid onto a print medium, some aspects of the system complicate its implementation. For example, since the nozzles of the print head assembly open to the exterior of the print head assembly and point downwards, the printing fluid or other printable material may leak out of the print head assembly via the nozzles if a negative pressure is not maintained in the fluid chamber. To combat this leakage, a negative pressure is maintained inside the fluid chamber. To maintain this negative pressure, a print head assembly may include components to regulate the pressure inside the fluid chamber of the print head assembly. These components may include moveable levers restrained by a spring which in turn operate a valve that admits fluid at a pressure and a flow rate suitable for printing such that the negative pressure is maintained in the fluid chamber to prevent the printing fluid from drooling from the nozzles.

However, these components in the print head assembly can be relatively large in size, have a large part count, and may be hard to assemble during time of manufacture. These factors add to the overall size, cost, and complexity of the print head assembly.

Accordingly, the principles described herein include a rocker valve to regulate pressure inside a fluid chamber of a print head assembly. Such a rocker valve includes a number of rails to transitionally connect an arm of a spring to the rocker valve such that the arm of the spring transitions across the rocker valve to actuate the rocker valve. As the arm of the spring moves along the rocker valve surface, a first side of the rocker valve selectively engages with a valve seat. More specifically, as the arm of the spring moves along the rocker valve surface, a number of pivot arms allow the rocker valve to pivot between a closed position and an open position such that the first side of the rocker valve selectively engages with the valve seat to regulate pressure inside a print head assembly.

In other words, the rocker valve is used to regulate the pressure inside of the print head assembly. Specifically, the rocker valve opens and closes based on the printing fluid demand of a print head assembly pulling printing fluid out of the fluid chamber. Further, the rocker valve is used to maintain a negative pressure in the print head assembly at all times through temperature and atmospheric pressure changes.

Such a rocker valve regulates the pressure inside of the print head assembly while reducing the size of the components in the print head assembly, reducing the part count to regulate pressure inside the print head assembly, and simplifying the manufacture of the print head assembly such that the overall size and complexity of the print head assembly is reduced while still delivering high performance.

In the present specification and in the appended claims, the term "transitionally connected" or "transitionally attached" refers to a connection or attachment between members where the point of connection or attachment can move or transition relative to at least one of the member where the connection is made. An example is an arm of a first member that is attached to a slider that is on a second member, where the slider is attached to, but slides with respect to, the second member on which it resides. This is one example of a transitional connection or transitionally attached. The arm is attached to the member and has a fixed attachment to the slider. However, the point of connection with the second member can move or transition because the slider slides thereon. Thus, to transitionally connect two members is to form a connection between them where a point of the connection is moveable, or can transition, with respect to the member at which that connection or attachment point is formed.

In the present specification and in the appended claims, the term "fluid chamber" refers a portion of a print head assembly that retains printing fluid. Specifically, the fluid chamber retains the printing fluid prior to the printing fluid being expelled by the nozzles. In an example, once the printing fluid is expelled by the nozzles, printing fluid from an external printing fluid supply or air flows into the fluid chamber to regulate the pressure inside of the print head assembly.

In the present specification and in the appended claims, the term "rocker valve" means a mechanism used to regulate pressure inside a print head assembly. The rocker valve transitions between an open position and a closed position by pivoting or rocking.

In the present specification and in the appended claims, the term "valve seat" means a component of a valve with an opening that is selectively covered by the valve. When the valve is not seated in the valve seat, the opening allows fluid to flow into the fluid chamber of the print head assembly. The fluid may be a liquid such as such a printing fluid or a gas such as air. A rocker valve selectively engages with a valve seat such that fluid is allowed to flow, or is prevented from flowing, through the opening in the valve seat into the fluid chamber of the print head assembly.

In the present specification and in the appended claims, the term "regulator bag" refers to a mechanism inside the fluid chamber that inflates or deflates in response to a difference in pressure. Specifically, the regulator bag inflates and deflates based on a change in the pressure relative to a location inside of a fluid chamber and a location outside of the fluid chamber. The regulator bag inflates when a pressure inside the fluid chamber decreases relative to a pressure outside of the fluid chamber (i.e. a pressure that is not desired and/or optimal). The regulator bag deflates when the pressure inside the fluid chamber increases relative to the pressure outside of the fluid chamber (i.e. until a negative pressure that is optimal is reached).

In the present specification and in the appended claims, the term "body" means a portion of a print head assembly. The body forms a fluid chamber to house a number of components for regulating pressure inside the print head assembly.

Further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Referring now to the figures, FIG. 1 is a cutaway side view of a system for regulating pressure in a print head assembly, according to one example of principles described herein. As will be described below, a print head assembly (100) includes a number of components to regulate pressure in the fluid chamber (122) of the print head assembly (100).

A body (104) of the print head assembly (100) defines a portion of a fluid chamber (122) that houses a number of components. The fluid chamber (122) retains printing fluid, other printable material, air, or combinations thereof. For example, the fluid chamber (122) holds printing fluid that is to be delivered to nozzles of the print head assembly (100) for deposition on to a print medium.

In an example, a negative pressure is created and maintained inside of the fluid chamber (122). Maintaining a negative pressure inside of the fluid chamber (122) serves a number of purposes. For example, the print head assembly (100) includes a number of nozzles that are connected to the fluid chamber (122) and are open to the exterior of the print head assembly (100). The nozzles are used to eject printing fluid or other printable material from the fluid chamber (122) onto the print medium to form an image. Since the nozzles of the print head assembly (100) are open to the exterior of the print head assembly (100) and may point downward, the printing fluid or other printable material can leak out of the print head assembly (100) via the nozzles due to the effects of gravity.

Further, the printing fluid or other printable material may leak out of nozzles due to temperature and/or atmospheric pressure changes, such as when the printer is transported from one location to another location. As a specific example, as the temperature rises, the air, printing fluid, or other printable material expands inside of the fluid chamber (122). This expansion may reduce the negative pressure such that the printing fluid or other printable material can leak out of the nozzles. While the surface tension of the printing fluid or other printable material resists air bubbles from penetrating into the fluid chamber (122), extreme changes in atmospheric pressure or altitude, can cause the air bubble inside the fluid chamber (122) to expand such that the printing fluid or other printable material can leak out of the nozzles. In other words, a pressure difference between the inside of the fluid chamber (122) and the outside of the fluid chamber (122) is based on changes in temperature, atmospheric pressure, altitude, or combinations thereof. In some examples, these events (i.e. temperature changes, atmospheric pressure changes, or altitude changes) cause the pressure regulating component to transition between an open position and a closed position.

The print head assembly (100) as described herein addresses these events. Specifically, the print head assembly accounts for environmental changes, because the second arm (110-2) of the spring (108) translates a small distance on the rails (224) before crossing a specific section on the rocker valve(118) such that the rocker valve (118) transitions to the open position. As will be described below, a number of components are used to regulate pressure in the print head assembly (100) such that the printing fluid or other printable material does not leak out of the nozzles.

The print head assembly (100) also includes a lid (102) that defines a portion of the fluid chamber (122). The lid (102) attaches to the body (104) to provide a sealed fluid chamber (122) so as to maintain the negative pressure inside the fluid chamber (122). To create this seal, the body (104) includes a first sealing component such as ridges (120-1, 120-2). The ridges (120) are sized to fit into corresponding sealing components in the lid (102), such as a slot that receives the ridges (120). In this fashion, a seal is maintained between the body (104) and the lid (102). In other examples, seals, rubber gaskets, or other sealing mechanisms may be used to provide a seal between the body (104) and the lid (102).

Figure 3:
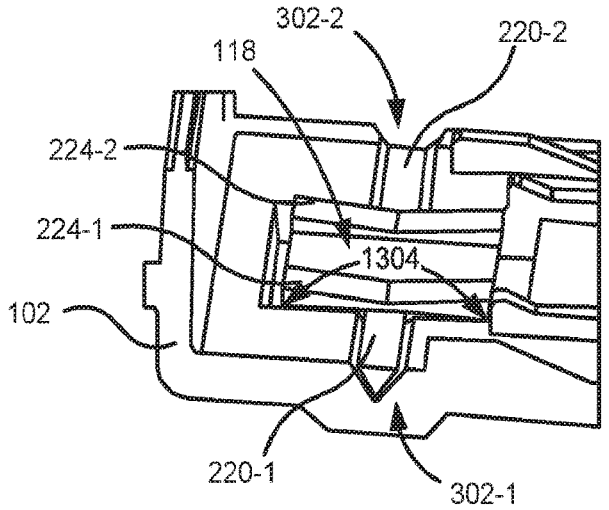
FIG. 3 is an underside isometric view of the rocker valve inserted into a lid, according to one example of principles described herein.
Figure 4:
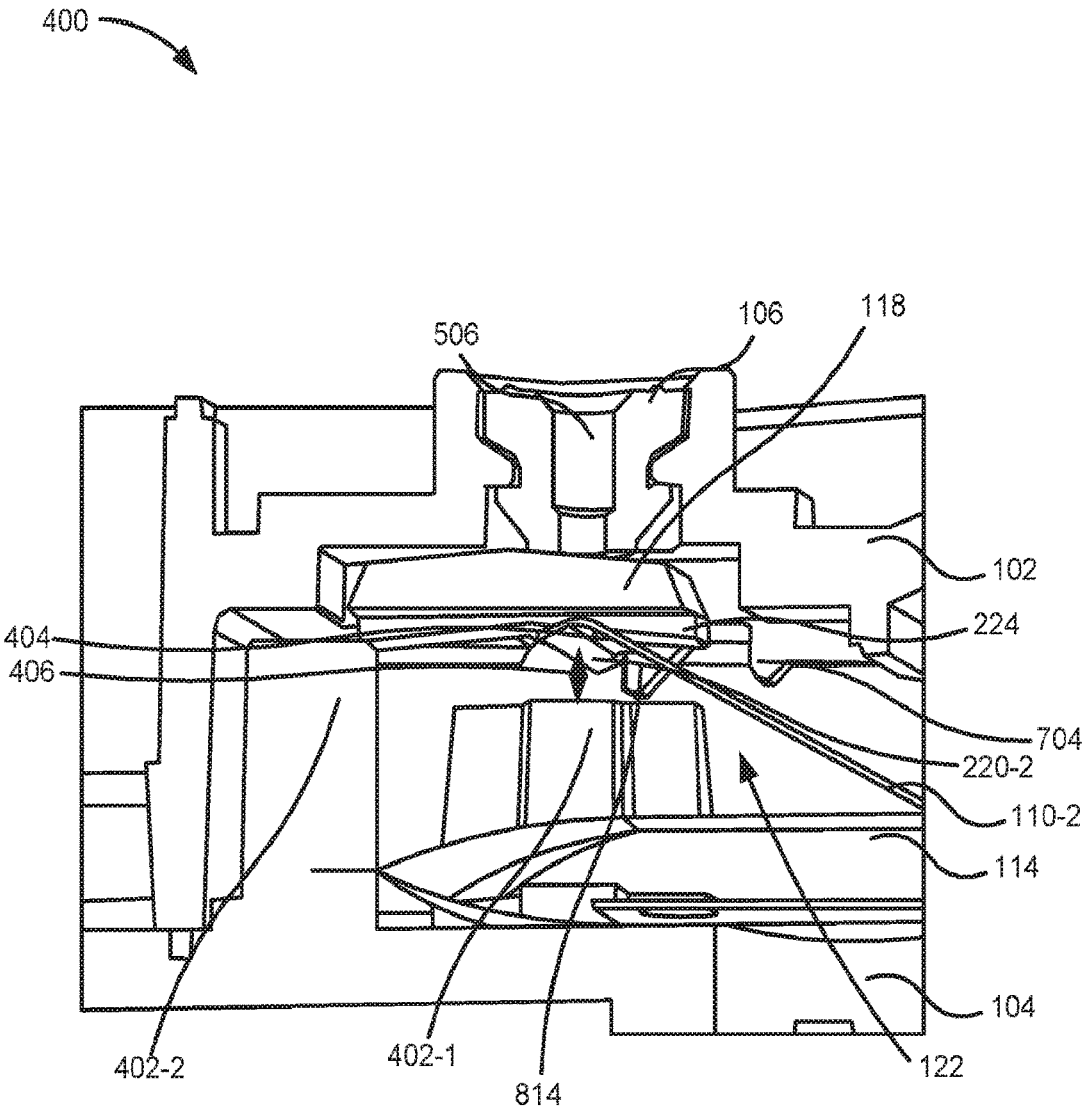
FIG. 4 is an isometric view of retainer ribs, according to one example of principles described herein.
Figure 7:
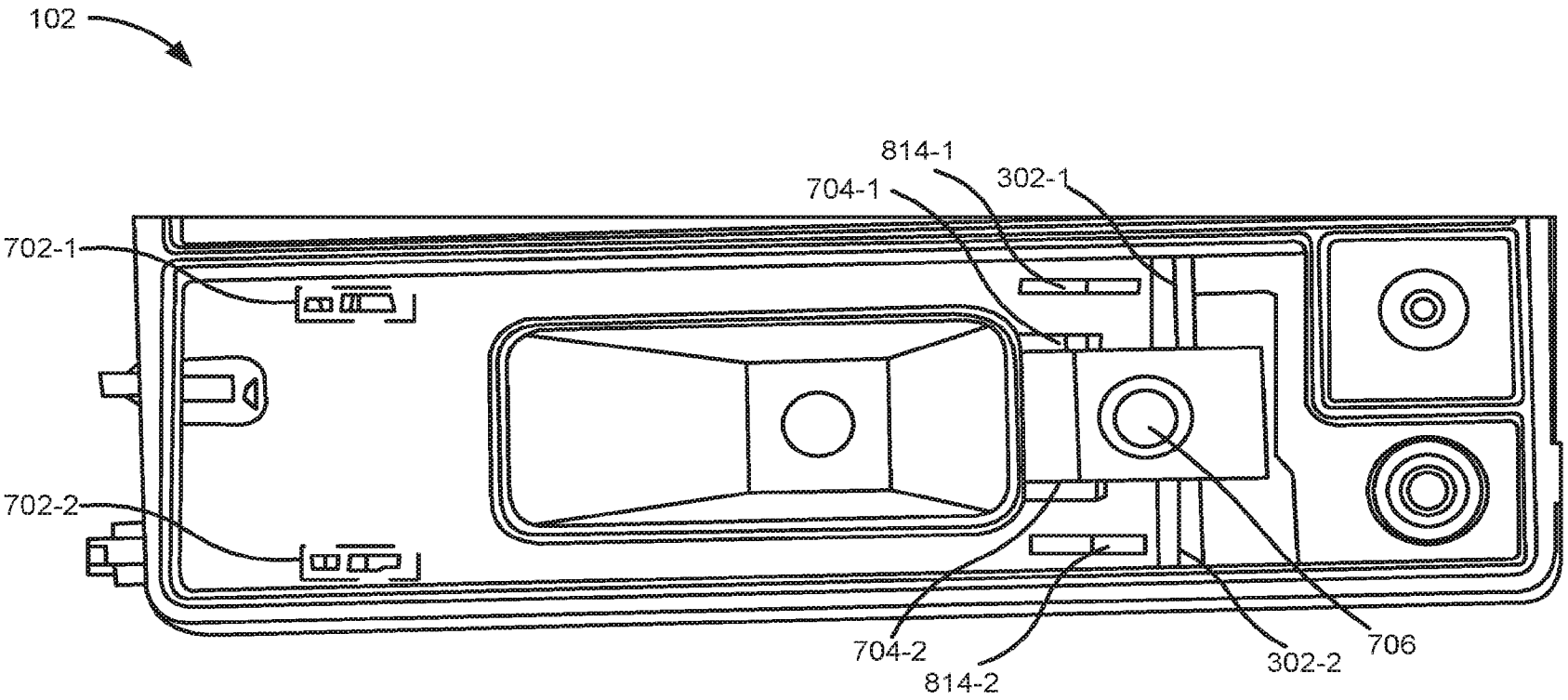
FIG. 7 is an isometric view of an underside of the lid, according to one example of principles described herein.

As will be described in other parts of this specification, the lid (102) includes a number of mounts (702), as depicted in FIG. 7, for retaining an end of a first arm (110-1) of a spring to the lid (102), an opening (706) to accommodate a valve seat (106), retainer ribs (402) as depicted in FIG. 4, and a number of pivot grooves (302), as depicted in FIG. 3.

Disposed inside the fluid chamber (122) is a regulator bag (114) that inflates or deflates in response to a difference in pressure as indicated by the arrow (1301). In an example, the regulator bag (114) is located between a bottom portion of the body (104) and a bottom section (112) of a spring (108).

Figure 9A:
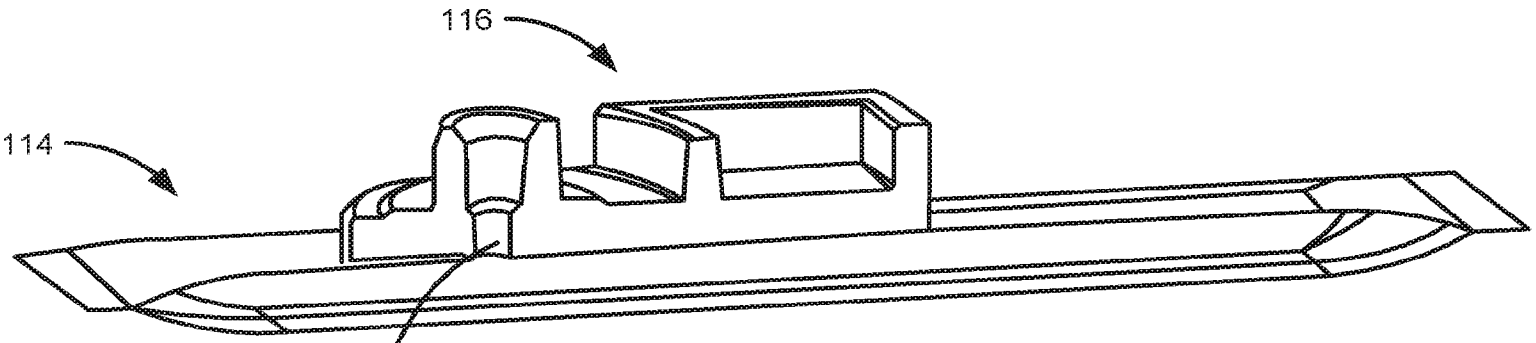
FIG. 9A is an isometric view of a regulator bag with a fitment, according to one example of principles described herein.

As will be described below, the regulator bag (114) is attached to a fitment (116) that has an opening (912). The opening (912), as depicted in FIG. 9A, exposes the regulator bag (114) to an external pressure, such as atmospheric pressure. The regulator bag (114) inflates or deflates based on a pressure difference between an inside the fluid chamber (122) and outside the fluid chamber (122). For example, if the difference in pressure exceeds a threshold value, the threshold being, for example, a positive pressure, the regulator bag (114) inflates. If the difference in pressure is a negative pressure that is beyond a desired amount, the regulator bag (114) inflates.

A spring (108) is used to further regulate the pressure inside the print head assembly (100). The spring (108) includes a bottom surface (112). The bottom surface (112) of the spring (108) is in contact with the regulator bag (114). As the regulator bag (114) inflates and deflates, the bottom surface (112) of the spring (108) moves, as indicated by arrow 1302, such that the arms (110-1, 110-2) of the spring (108) deflect. The first arm (110-1) is securely connected to a mount on the lid (102) such that as the regulator bag (114) interacts with the spring (108), the first arm (110-1) does not move at an attachment point to the lid (102).

Figure 2A:
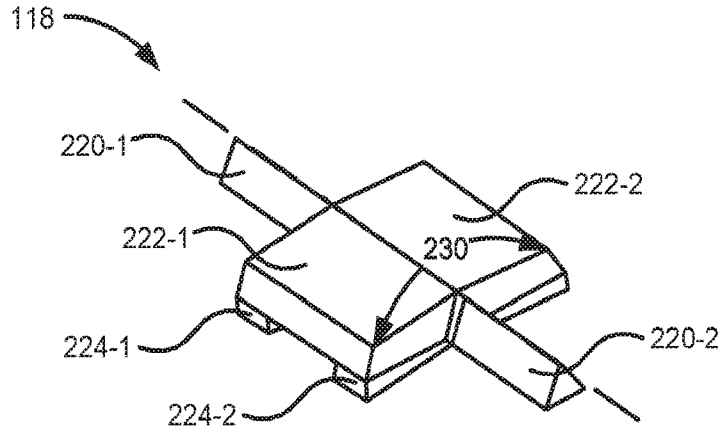
FIG. 2A is an isometric view of a top side of a rocker valve, according to one example of principles described herein.
Figure 2B:
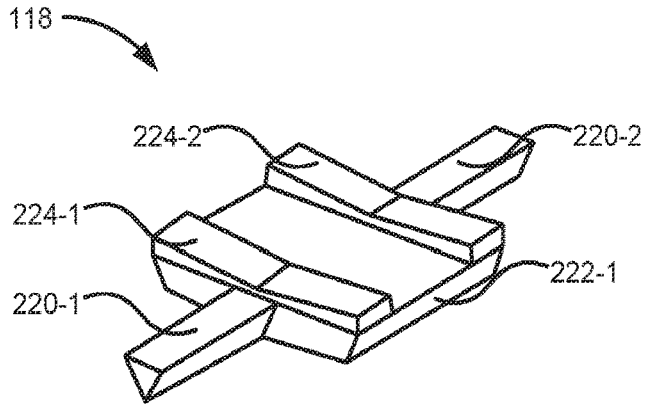
FIG. 2B is an isometric view of a bottom side of the rocker valve, according to one example of principles described herein.

By comparison, the second arm (110-2) is disposed between rails (of a rocker valve (118), as depicted in FIGS. 2A and 2B, such that as the regulator bag (114) interacts with the spring (108), the motion of the regulator bag (114), indicated by arrow 1301, is perpendicular to the motion of the second arm (110-2), indicated by arrow 1303. As will be described in FIGS. 2A and 2B, the second arm (110-2) moves between a first side of the rocker valve (118) and a second side of the rocker valve (118) as the regulator bag (114) inflates and deflates. This motion actuates the rocker valve (118) between an open and closed position.

In other words, the regulator bag (114) inflates as fluid is drawn out of the fluid chamber (122) and the pressure in the fluid chamber (122) becomes more negative (i.e. the pressure decreases). Eventually the regulator bag's inflation translates the second arm (110-2) of the spring (108) as identified by arrow 1303 across the rails (224) to transition the rocker valve (118) from the closed position to the open position. As the regulator bag (114) deflates resulting from fluid flowing into the fluid chamber (122). In this example, the pressure in the fluid chamber (122) becomes less negative (i.e. the pressure increases). Eventually the regulator bag's deflation translates the second arm (110-2) of the spring (108) across the rails (224) to transition the rocker valve (118) from the open position to the closed position.

As described above, the rocker valve (118) pivots, between an open position and a closed position as indicated by the arrow 1304 based on the inflation or deflation of the regulator bag (114). In the open position, the rocker valve (118) does not engage with a valve seat (106). This allows fluid such as air and/or printing fluid to flow into the fluid chamber (122) via the opening (506) in the valve seat (106). In the closed position, the rocker valve (118) engages with the valve seat (106). This prohibits fluid such as air and/or printing fluid to flow into the fluid chamber (122) via the opening (506) in the valve seat (106). As a result, the rocker valve (118) selectively engages with the valve seat (106) to regulate pressure within the fluid chamber (122).

In an example, the opening (506) in the valve seat (106) is sized such that the fluid is admitted at a pressure and flow rate suitable for printing and such that a desired negative pressure is maintained in the fluid chamber (122). In an example, the pressure is between 3 to 15 inches of water of negative pressure. However, depending on the design of the print head assembly (100) and the intended purpose of the printer, the pressure could be between 0 and 30 inches of water of negative pressure. In this example, the flow rate is between 20 to 25 cubic centimeters per minute. However, depending on the design of the print head assembly (100) and the intended purpose of the printer, the flow rate could be less than 20 cubic centimeters per minute or greater than 25 cubic centimeters per minute.

While this example has been described with reference to the components being located in specific locations within the print head assembly (100), the components can be located in any suitable location. For example, instead of the valve seat (106) and rocker valve (118) being located in the lid (102), the valve seat (106) and rocker valve (118) could be located in the body (104) as long as the spring (108) and regulator bag (114) are located appropriately within the print head assembly (100) such that the desired functions described above are maintained.

FIGS. 2A to 10B will now describe each of the components in detail. Further, an overall example of how the system operates will be described in FIGS. 11A and 11B.

FIG. 2A is an isometric view of the top of a rocker valve (118), according to one example of principles described herein. As will be described below, the rocker valve (118) includes a first side (222-1), a second side (222-2), and a number of pivot arms (220).

The rocker valve (118) is made of any material compatible with the fluid retained inside the fluid chamber (122). In other words, the rocker valve (118) is made of any material that does not degrade, erode, corrode, or otherwise deform when it comes in contact with the fluid in the fluid chamber (122). For example, the rocker valve (118) may be made out of plastic, such as polyoxymethylene. In another example, the rocker valve (118) is made out of a metal. Further, the rocker valve (118) may be made out of both a plastic and a metal. In some examples, the rocker valve (118) can be coated with a non-stick material to allow for a smoother pivot between the open position and the closed position. An example of such a non-stick material is a synthetic compound of fluoropolymer of tetrafluoroethylene such as polytetrafluorethylene.

The first side (222-1) of the rocker valve (118) selectively engages with a valve seat (106) based on a position of the second arm (110-2) of the spring (108) relative to the first side (222-1) of the rocker valve (118). The surface of the first side (222-1) of the rocker valve (118) may be smooth such that when the first side (222-1) of the rocker valve (118) engages with the valve seat (106), a seal is made between the first side (222-1) of the rocker valve (118) and the valve seat (106). As a result, fluid such as air and/or printing fluid cannot flow into the fluid chamber (122) when the rocker valve is in the closed position.

The second side (222-2) of the rocker valve (118) may be similar to the first side (222-1) of the rocker valve (118), in that it is smooth. However, the second side (222-2) of the rocker valve (118) is positioned at an angle (230) relative to a first side (222-1) of the rocker valve (118). In an example, the angle (230) is less than 90 degrees. In another example, the angle (230) is between 5 to 40 degrees. In another example, the angle (230) is 10 degrees. This angle (230) allows the rocker valve (118) to pivot between the closed position and the open position. For example, in the open position, a gap is created between the first side (222-1) of the rocker valve (118) and the opening (506) of the valve seat (106) to allow the fluid to flow into the fluid chamber (122). In the closed position, the first side (222-1) of the rocker valve (118) is flush against the valve seat (106) such that the fluid is prohibited from flowing into the fluid chamber (122).

The pivot arms (220) of the rocker valve (118) pivot the rocker valve (118) between a closed position and an open position.

In some examples the pivot arms (220) are triangular in shape as illustrated in FIG. 2A. However, the pivot arms (220) can be other shapes. For example, the pivot arms (220) can be oval in shape, round in shape, or other shapes.

In an example the rocker valve (118) is symmetrical with respect to the dashed line in FIG. 2A. As a result, when inserting the rocker valve (118) into the pivot grooves (302) during assembly, the rocker valve (118) can be inserted in more than one way. In other examples, the rocker valve (118) is asymmetrical. In this example, when inserting the rocker valve (118) into the pivot grooves (302) during assembly, the rocker valve (118) can be inserted in only one way.

FIG. 2B is an isometric view of the bottom of the rocker valve (1180, according to one example of principles described herein.

As illustrated, in some examples, the rocker valve (118) includes a number of rails (224-1, 224-2). The rails (224) are used to guide the second arm (110-2) of the spring (108) along the rocker valve (118) such that the second arm (110-2) actuates the rocker valve (118). For example, the rails (224) guide the second arm (110-2) as it transitions between the first side (222-1) of the rocker valve (118) and the second side (222-2) of the rocker valve (118) based on the regulator bag (114) interacting with the spring (108) as described above.

FIG. 3 is an isometric view of the rocker valve (118) inserted into a lid (102), according to one example of principles described herein. Specifically, FIG. 3 depicts an upside down view of the rocker valve (118) as disposed in the lid (102).

As depicted in FIG. 3, the lid (102) may include a number of pivot groves (302-1, 302-2). The pivot grooves (302) are sized to accommodate the pivot arms (220) of the rocker valve (118) such that the rocker valve (118) can pivot between the open position and the closed position and to allow the pivot arms (220) to rotate about their respective longitudinal axes when seated. While FIG. 3 depicts triangular pivot arms (220) and triangular pivot grooves (302), any shape pivot arm (220) and groove (302) may be used. The triangular shape of the pivot arms (220) as well as the triangular shape of the pivot grooves (302) aid in stopping the rocker valve (118) from pivoting too far.

While FIG. 3 illustrates using pivot grooves (302) as a mechanism to attach the rocker valve (118) to the lid (102), other mechanisms may be used based on the design of the rocker valve (118). For example, if the pivot arms (220) of the rocker valve (118) are round in shape and shorter, the lid (102) may include a number of holes to accommodate this pivot arm such that these pivot arms are pressed into or snap into the holes.

FIG. 4 is an isometric view of retainer ribs, according to one example of principles described herein. In some examples, the body (104) includes a number of retainer ribs (402-1, 402-2). The retainer ribs (402) prevent the rocker valve (118) from dislodging from the pivot grooves (302) in the lid (102). Each of the retainer ribs (402) is located above each of the pivot arms (220). For example, the first retainer rib (402-1) is located above the first pivot arm (220-1). The second retainer rib (402-2) is located above the second pivot arm (220-2). A gap (406) is created between the pivot arms (220) and the retainer ribs (402) such that the rocker valve (118) can pivot, but if the printer is subjected to external forces, the rocker valve (118) cannot become dislodged from the pivot grooves (302) because the pivot arms (220) make contact with the retainer ribs (402).

Further, FIG. 4 depicts how the valve seat (106) is compression fitted into the lid (102). In an example, the opening (706) in the lid (102) has features that mate with corresponding features in the valve seat (106) such that once the valve seat (106) is inserted into the lid (102), these corresponding features secure the valve seat (106) to the lid (102). By compression fitting the valve seat (106) to the lid (102), a seal is made between the valve seat (106) and the lid (102).

Figure 5:
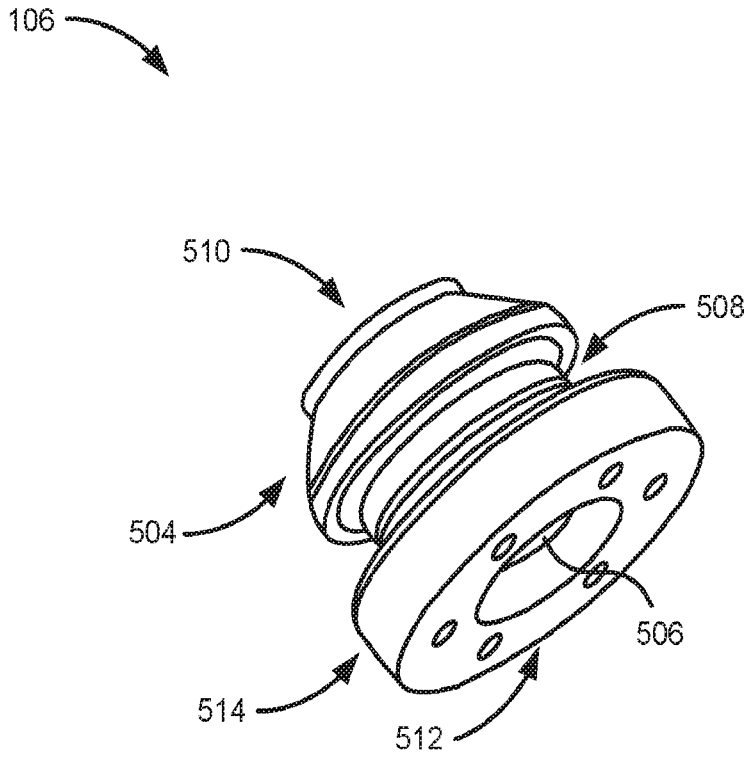
FIG. 5 is an isometric view of a valve seat, according to one example of principles described herein.

FIG. 5 is an isometric view of a valve seat (106), according to one example of principles described herein. As illustrated, the valve seat (106) includes a dart head seat (504). The dart head seat (504) is shaped such that the valve seat (106) can be compression fitted into the lid (102) as described above. In an example, a contact portion (510) of the dart head seat (504) is the portion of the valve seat (106) that selectively makes contact with the first side (222-1) of the rocker valve (118). In some examples at least the contact portion (510) of the dart head seat (504) is made out of a material suitable to provide a seal between the contact portion (510) of the dart head seat (504) and the first side (222-1) of the rocker valve. Materials include, for example, a polymer, such as a rubber or an elastomer, a silicone, other elastic material, or combinations thereof. In other examples the entire valve seat (106) is made of any of these materials, other suitable materials, or combinations thereof.

Further, the valve seat (106) includes a material that has a predefined level of durometer or stiffness. Durometer is one of several measures of the hardness of a material and may be defined as a material's resistance to permanent indentation. By selecting the proper material durometer for the valve seat (106), the sealing function of the valve seat (106) may be optimized. For example, a relatively low durometer (i.e. soft material) may best function as to sealing the interface between the first side (222-1) of the rocker valve (118) and the valve seat (106).

The valve seat (106) includes a thin portion (508). The thin portion (508) is located between the dart head seat (504) and a seal face (514). The diameter of the thin portion (508) is smaller than the diameter of the dart head seat (504) and the seal face (514). This allows the valve seat (106) to be compression fitted into the opening (706) in the lid (102) such that the valve seat (106) is securely attached to the lid (102).

The valve seat (106) includes the seal face (514). The seal face (514) is located on the opposite end of the dart head seat (504). The top portion (512) of the seal face (514) sits flush with the top of the lid (102).

As illustrated, the valve seat (106) includes an opening (506). The opening (506) allows fluid to flow into the void fluid chamber (122) as described above.

While this example has been described with reference to the valve seat (106) being compression fitted into the lid (102), the valve seat's design could be altered such that the valve seat (106) isn't compression fitted into the lid (102). For example, the valve seat (106) and the materials of the valve seat (106) may be such that a volcano orifice is molded into the lid (102) and the seal includes an elastomer material attached to or co-molded into the rocker valve (118). As a result, the orientation of the valve seat (106) is reversed when the valve seat (106) is a volcano orifice is molded into the lid (102) instead of being compression fitted into the lid (102).

Figure 6:
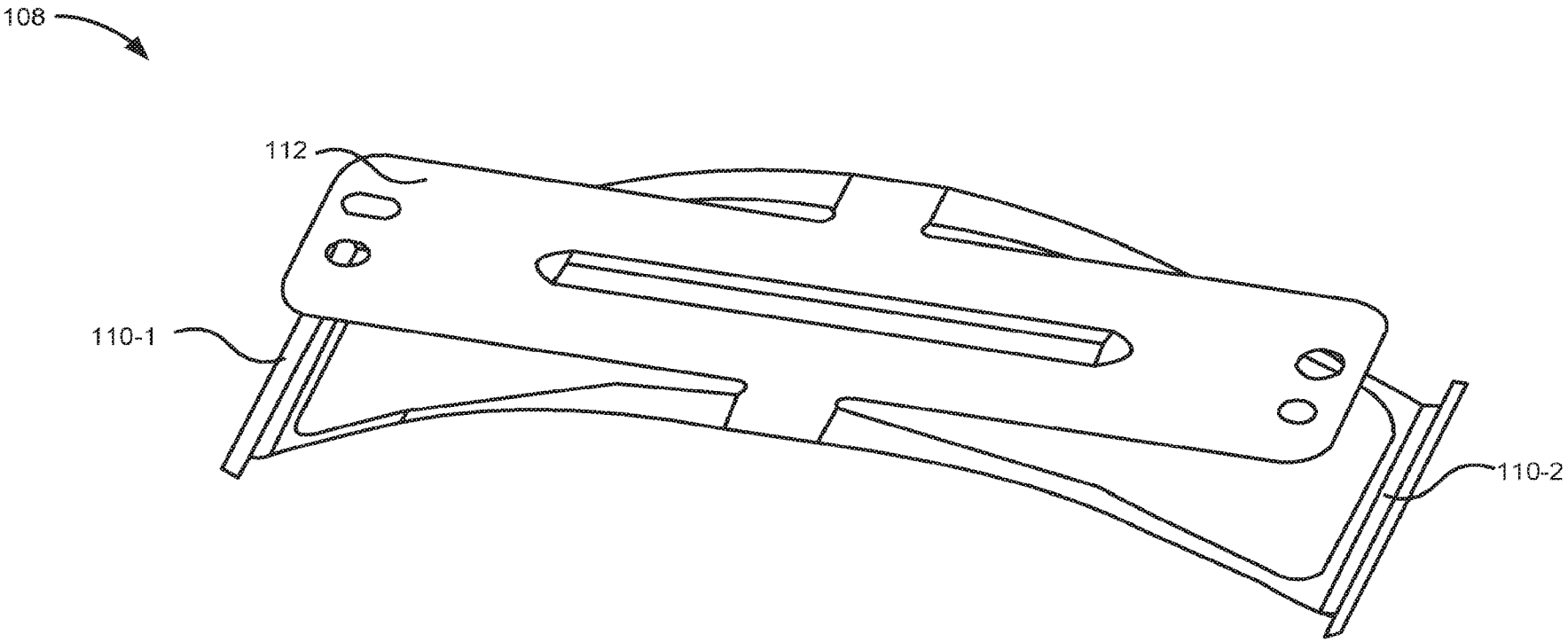
FIG. 6 is an isometric view of a spring, according to one example of principles described herein.

FIG. 6 is an isometric view of a spring (108), according to one example of principles described herein. Specifically, FIG. 6 is an upside down view of the spring (108).

The spring (108) includes a bottom surface that interacts with the regulator bag (114). For example, as the regulator bag (114) inflates, the regulator bag (114) presses against the bottom surface (112) to compress the spring (108). In some examples, the spring (108) is not attached to, but rests on the regulator bag (114).

The spring (108) also includes a first arm (110-1), which as described above, is fixedly mounted to the lid (102).

By comparison, the second arm (110-2) of the spring (108) is free to move and is guided in movement along the rocker valve (118) via rails. The second arm (110-2) moves between a first side (222-1) of the rocker valve (118) and a second side (222-2) of the rocker valve as the spring (108) compresses and decompresses. This motion causes the rocker valve (118) to pivot, via the pivot arms (220), between the open position and the closed position as described above.

The spring force of the spring (108) is determined, at least in part, based on the operating pressure of the print head assembly (100). For example, if a print head assembly (100) is designed to operate at low pressures, the spring force of the spring (108) may be relatively low. However, for a print head assembly (100) that is designed to operate at extreme negative pressures, the spring force of the spring (108) may be relatively high. The spring force of the spring (108) may be defined by the following equation:

$$F=k*x \qquad \text{Eq. 1}$$

where F is the spring force, k is the spring constant of the spring (108) and x is the deformation of the arms (110) needed to transition the second arm (110-2) from a first side (222-1) of the rocker valve (118) to the second side (222-2) of the rocker valve (118). As a result, the spring constant can be adjusted based on the needs of the print head assembly (100) to maintain a desired negative pressure.

FIG. 7 is an isometric view of an underside of the lid, according to one example of principles described herein.

In some examples, the lid (102) includes a number of mounts (702) to securely attach the first arm (110-1) of the spring (108) to the lid (102) such that the first arm (110-1) of the spring (108) does not move when the spring (108) is compressed or decompressed. An example of the mount (702) is provided below in connection with FIG. 8B.

The lid (102) includes an opening (706) to house the valve seat (106). As mentioned above, the shape (e.g., the contour) of the opening (706) corresponds to the shape of the valve seat (106) such that the valve seat (106) can be compression fit into the opening (706).

FIG. 7 also depicts the number of pivot grooves (302) that receive the pivot arms (220) of the rocker valve (118) and that allow the rocker valve (118) to pivot between the open position and the closed position. In an example, the length of the pivot groves (302) is longer than the length of the pivot arms (220) of the rocker valve (118).

In some examples, the lid (102) includes a number of assist stops (704) and a number of spring stops (814). The assist stops (704) prevent the second arm (110-2) of the spring (108) from moving past a certain point during assembly. In other words the assist stops (704) prevent the second arm (110-2) from coming off of the rails (224) during movement. Additional detail regarding the assist stops (704) and spring stops (814) is now provided connection with FIG. 8A.

Figure 8A:
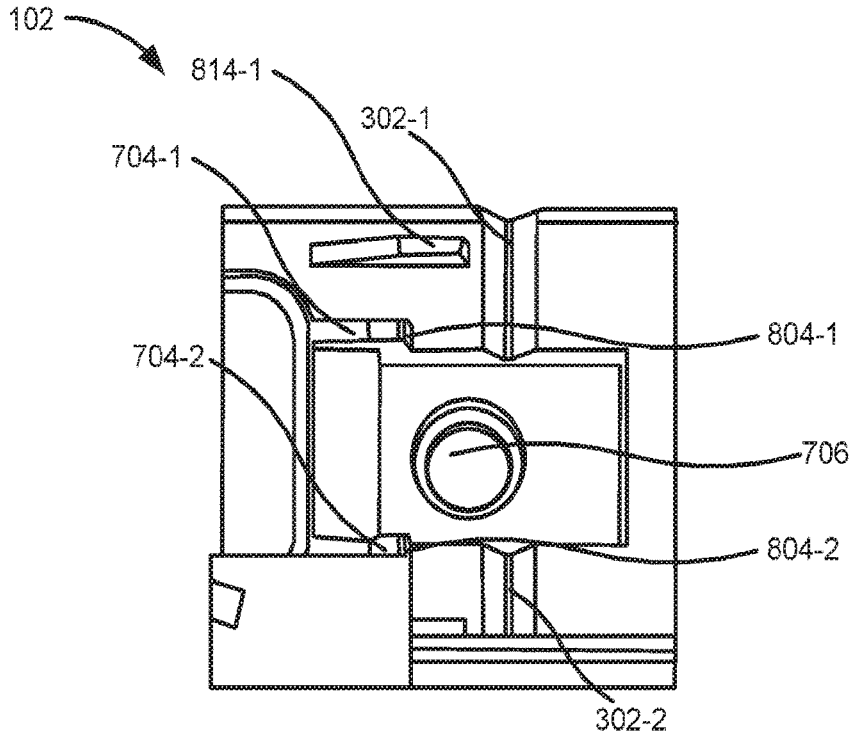
FIG. 8A is an isometric zoomed in view of a number of stops, according to one example of principles described herein.

Specifically, FIG. 8A is an isometric zoomed in view of a number of stops, according to one example of principles described herein. Specifically, FIG. 8A depicts assist stops (704) and spring stops (814).

The spring stops (814) are used during assembly to align the spring (108), specifically the second arm (110-2), to a desired position within the print head assembly (100). Once the lid (102) and the body (104) are assembled, the second arm (110-2) does not contact the spring stops (814) again. For example, the travel of the second arm is governed by a vertical height within the fluid chamber (122). In other words, the bottom section (112) collapses the regulator bag (114) against the lid (102) until further travel is limited by the lid (102). This happens before the second arm (110-2) contacts the spring stops (814).

In some examples, the lid (102) includes a number of assist stops (704-1, 704-2) to align the second arm (110-2) to the rails (224) of the rocker valve (118). Once the print head assembly (100) is assembled, the top portions (804) of the assist stops (704) prevent the bottom section (112) from contacting the rocker valve (118) when the spring (108) is at maximum compression. Without the assist stops (704), the bottom section (112) may contact the rocker valve (118) and push the rocker valve (118) to the closed position when the rocker valve (118) is supposed to be the open position.

Figure 8B:
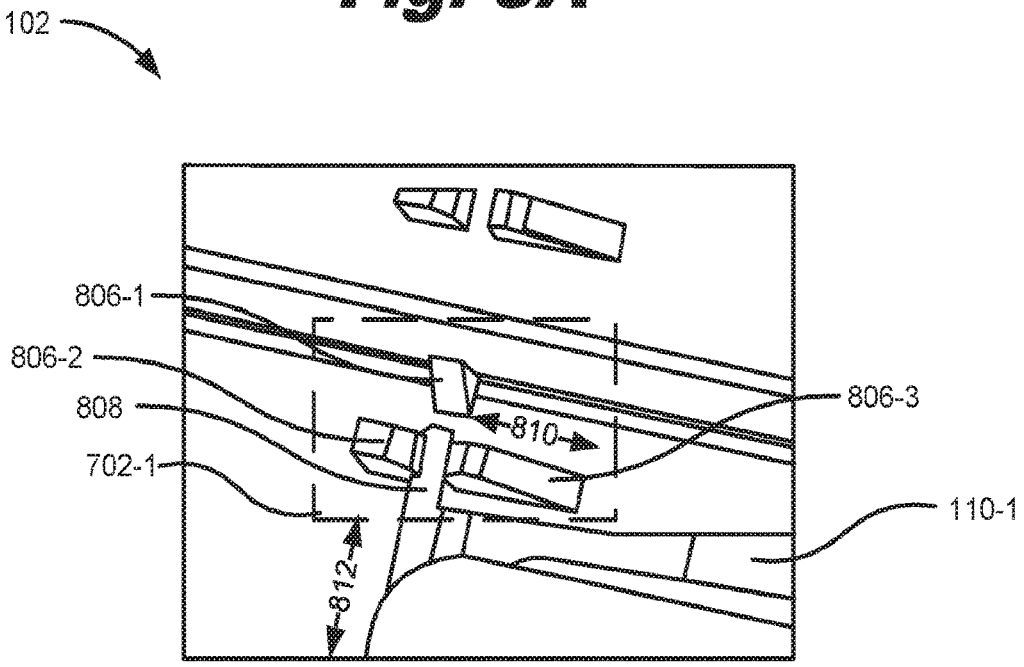
FIG. 8B is an isometric zoomed in view of a number of mounts, according to one example of principles described herein.

FIG. 8B is an isometric zoomed in view of a number of mounts (702), according to one example of principles described herein. The mounts (702) are disposed on the lid (102) and securely attach a first arm (110-1) of the spring (108) to the lid (102) such that the first arm (110-1) of the spring (108) does not move when the spring (108) is compressed or decompressed.

Although FIG. 8B illustrates and describes a first mount (702-1), it should be understood that the second mount (702-2) operates in the same manner described herein. As illustrated, the first mount (702-1) includes a first retainer (806-1) to allow limited movement of the first arm (110-1)

in a first direction (812). For example, the first arm (110-1) can move in the first direction (812) as indicated by arrow 812, until a portion (808) of the first arm (110-1) makes contact with the first retainer (806-1).

A second retainer (806-2) and a third retainer (806-3) of the first mount (702-1) allow limited movement of the first arm (110-1) in a second direction (810). For example, the first arm (110-1) can move in the second direction (810), until the portion (808) of the first arm (110-1) makes contact with the second retainer (806-2) or the third retainer (806-3).

Figure 9B:
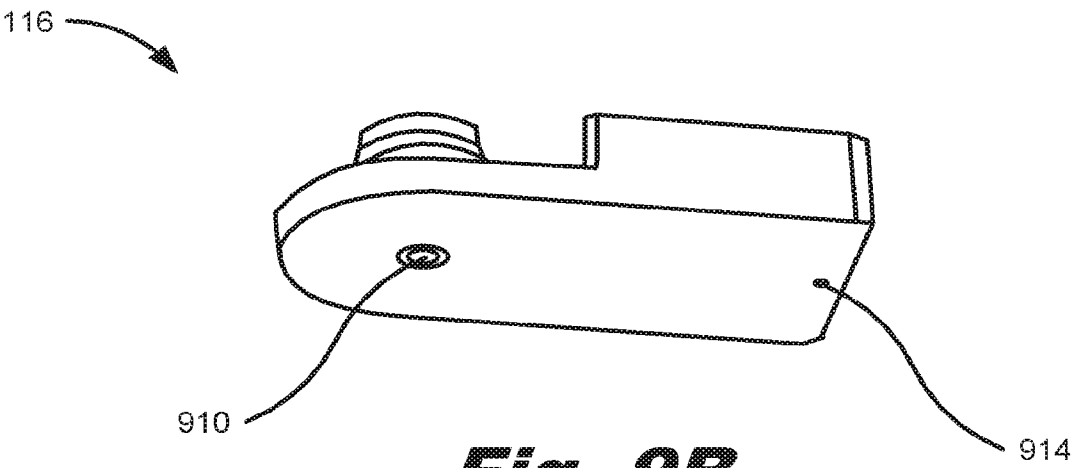
FIG. 9B is an isometric view of the fitment, according to one example of principles described herein.

FIG. 9A is an isometric view of the regulator bag (114) with a chamber interface (116), according to one example of principles described herein. FIG. 9B is an isometric view of an underside of the chamber interface (116), according to one example of principles described herein. The chamber interface (116) provides an interface between with the fluid chamber (122) and the regulator bag (114), specifically providing an opening (910) to the atmosphere such that the pressure difference is created.

In some examples, the chamber interface (116) includes a bag alignment stake (914). The bag alignment stake (914) is used to align the chamber interface (116) to the regulator bag (114) during assembly.

Figure 10A:
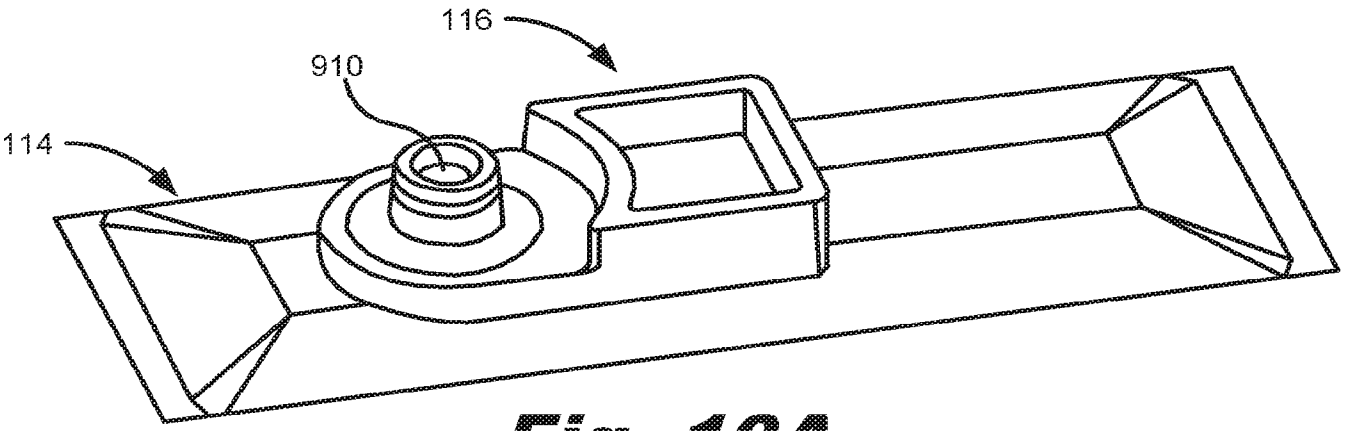
FIG. 10A is an isometric view of a deflated regulator bag with the fitment, according to one example of principles described herein.
Figure 10B:
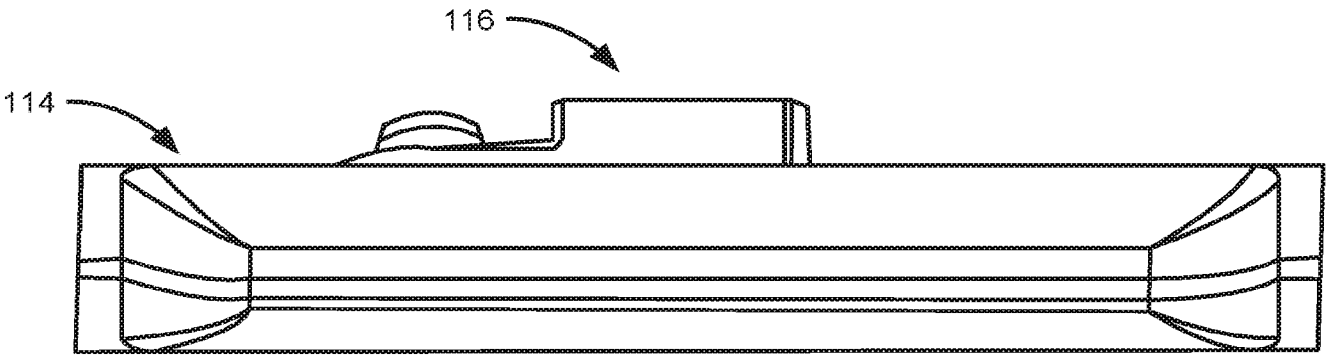
FIG. 10B is an isometric view of an inflated regulator bag with the fitment, according to one example of principles described herein.

In some examples, the shape and size of the chamber interface (116) is similar to corresponding opening in the body (104) such that the chamber interface (116) is compression fit into the opening of the body (104). FIG. 10A is an isometric view of a deflated regulator bag (114) with the chamber interface (116) disposed thereon. As mentioned above, the regulator bag (114) deflates when the pressure inside the fluid chamber (122) increases. With the regulator bag (114) deflated, the spring (108) is decompressed. By comparison, FIG. 10B is an isometric view of an inflated regulator bag (114) with a chamber interface (116) disposed thereon, according to one example of principles described herein. As mentioned above, the regulator bag (114) inflates when a non-optimal negative pressure is created (i.e. a more negative pressure than what is desired). With the regulator bag (114) inflated, the spring (108) is compressed.

Figure 11A:
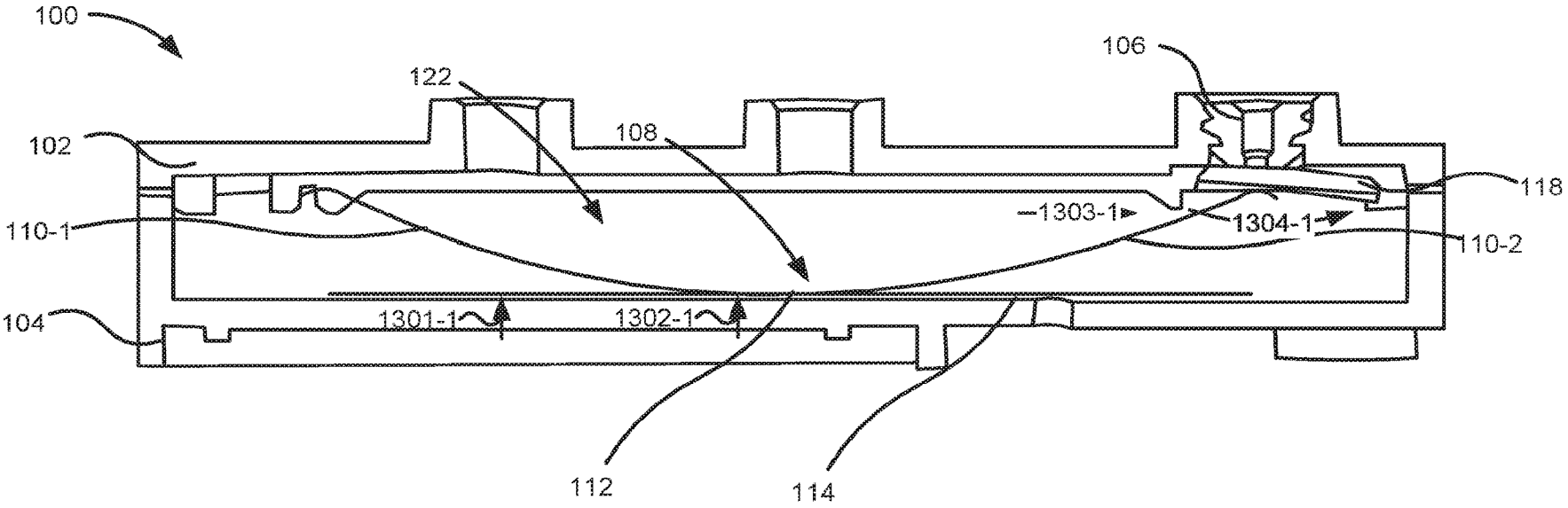
FIG. 11A is an isometric view of a system for regulating pressure inside of the print head assembly with the rocker valve in a closed position, according to one example of principles described herein.

FIG. 11A is an isometric view of a system for regulating pressure inside of a print head assembly (100) with a rocker valve (118) in a closed position, according to one example of principles described herein.

With a threshold pressure created relative to a location inside of a fluid chamber (122) and a location outside of the fluid chamber (122), the regulator bag (114) inflates as indicated by arrow 1301-1. In this example, the threshold pressure is less than 3 inches of water of negative pressure. Further, the spring constant of the spring (108) may be such that as soon as the pressure inside of the fluid chamber (122) exceeds the threshold pressure, the regulator bag (114) starts to inflate and compresses of the spring (108).

As the regulator bag (114) inflates, the regulator bag (114) compresses a spring (108) as indicated by arrow 1302-1. When the spring compresses (108), the second arm (110-2) of the spring (108), which is transitionally attached to a rocker valve (118), transitions from a first side (222-1) of the rocker valve (118) to the second side (222-2) of the rocker valve (118) as indicated by arrow 1303-1 to actuate the rocker valve (118).

Figure 11B:
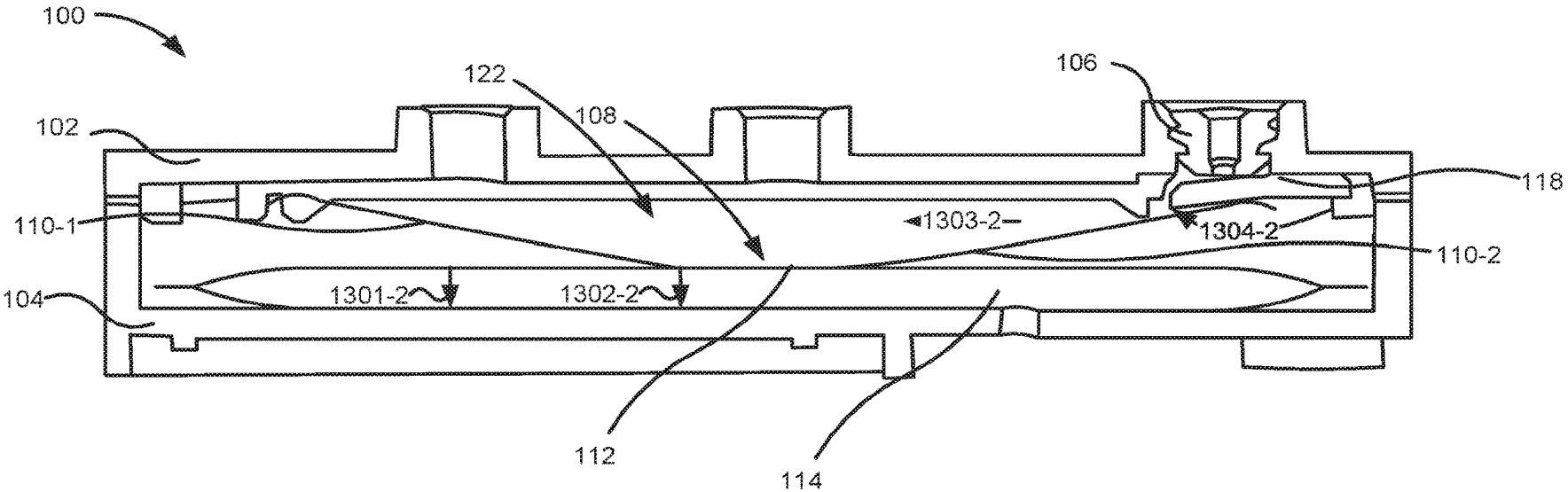
FIG. 11B is an isometric view of the system for regulating pressure inside of the print head assembly with the rocker valve in an open position, according to one example of principles described herein.

This allows the rocker valve (118) to transition from a closed position as depicted in FIG. 11A to an open position as depicted in FIG. 11B and as indicated by arrow 1304-1.

FIG. 11B is an isometric view of a system for regulating pressure inside of a print head assembly (100) with a rocker valve (118) in an open position, according to one example of principles described herein.

With a the rocker valve (118) in the open position, fluid is allowed to flow into the fluid chamber (122) to deflate the regulator bag (114) as indicated by the arrow 1301-2 and to (114) decompress the spring (108) as indicated by the arrow 1302-2. This allows the second arm (110-2) to transition from the second side (222-2) of the rocker valve (118) to the first side (222-1) of the rocker valve (118) as indicated by the arrow 1303-2. As a result, the rocker valve (118) actuates from the open position of FIG. 11B to the closed position of FIG. 11A as indicated by arrow 1304-2.

Figure 12:
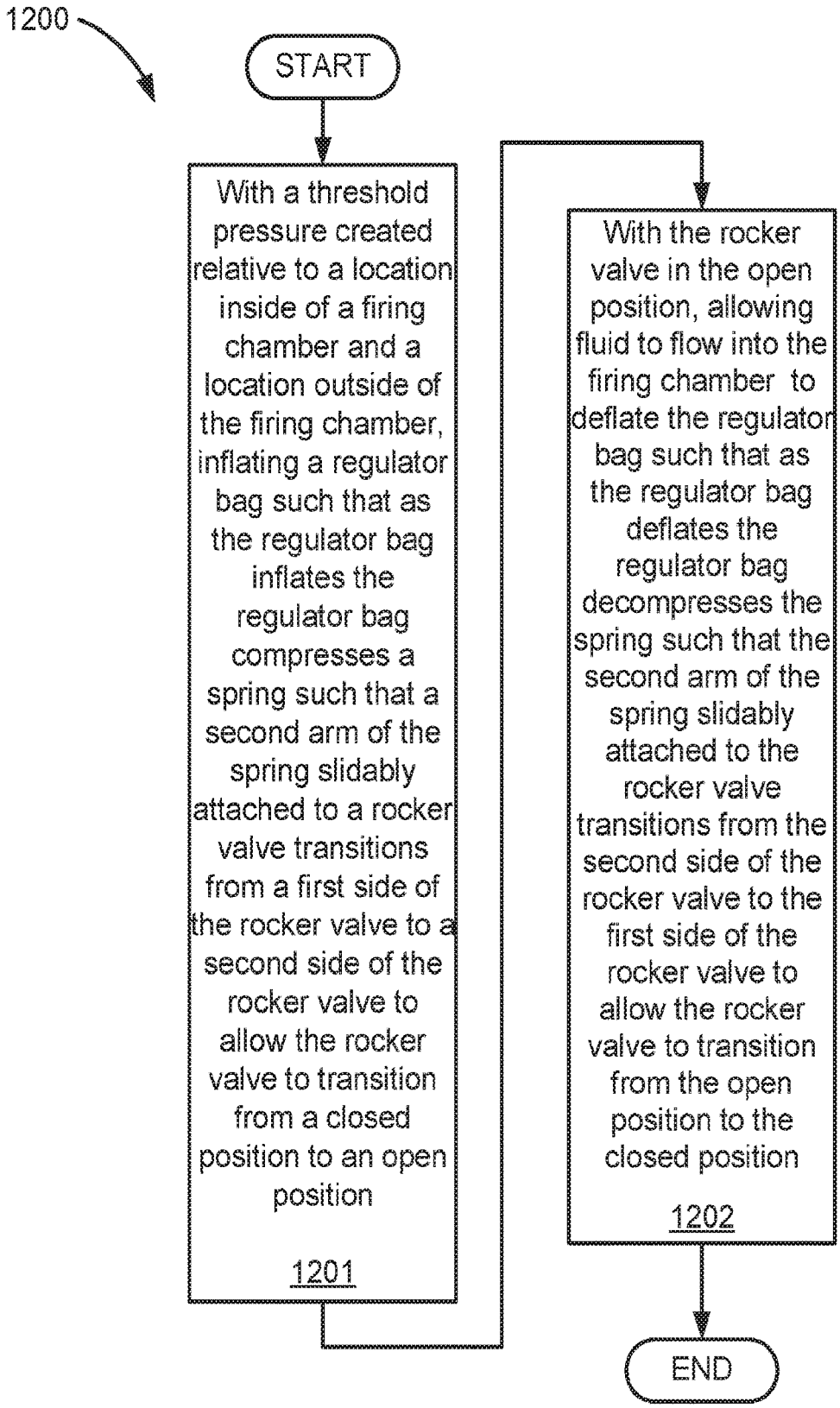
FIG. 12 is a flowchart of a method for regulating pressure inside of the print head assembly, according to one example of principles described herein.

FIG. 12 is a flowchart of a method (1200) for regulating pressure inside of a print head assembly (100), according to one example of principles described herein. In this example, the method (1200) includes with a threshold pressure created relative to a location inside of a fluid chamber (122) and a location outside of the fluid chamber (122), inflating (1201) a regulator bag (114) so as to compress a spring (108). In some examples the threshold pressure defines a pressure when the printing fluid can start to leak out of the fluid chamber (122) via the nozzles. In this example, the threshold pressure could be 0 inches of water of negative pressure, a small negative pressure, or a positive pressure. As the spring (108) compresses, a second arm (110-2) of the spring (108) which is transitionally attached to a rocker valve (118), transitions from a first side (222-1) of the rocker valve (118) to a second side (222-2) of the rocker valve (118). This transitional movement of the second arm (110-2), pivots the rocker valve (118) from a closed position to an open position. With the rocker valve (118) in the open position, (1202) fluid is allowed (1202) to flow into the fluid chamber (122) to deflate the regulator bag (114).

As the regulator bag (114) deflates, the regulator bag (114) decompresses the spring (108) and the second arm (110-2) of the spring (108) transitions from the second side (222-2) of the rocker valve (118) to the first side (222-1) of the rocker valve (118). This transitional motion pivots the rocker valve (118) to transition from the open position to the closed position. As a result, a desired negative pressure is restored within the fluid chamber (122) such that the printing fluid does not leak out of the fluid chamber (122) via the nozzles.

The preceding description has been presented to illustrate and describe examples of the principles described. This description is not intended to be exhaustive or to limit these principles to any precise form disclosed. Many modifications and variations are possible in light of the above teaching.

What is claimed is:

1. A rocker valve comprising:

a number of rails to transitionally connect an arm of a spring to the rocker valve such that the arm of the spring transitions across the rocker valve to actuate the rocker valve;

a first side of the rocker valve to selectively engage with a valve seat based on a position of the arm of the spring relative to the first side of the rocker valve; and a number of pivot arms to pivot the rocker valve between a closed position and an open position such that the first side of the rocker valve selectively engages with the valve seat to regulate pressure inside a print head assembly.

2. The rocker valve of claim 1, wherein the rocker valve pivots, via the pivot arms, to the closed position to prevent fluid from flowing into a fluid chamber of the print head assembly when the arm of the spring is in contact with the first side of the rocker valve.

3. The rocker valve of claim 1, wherein the rocker valve pivots, via the pivot arms, to the open position to allow fluid to flow into a fluid chamber of the print head assembly when the arm of the spring is in contact with a second side of the rocker valve.

4. The rocker valve of claim 1, wherein the rocker valve is coated with a non-stick material.

5. The rocker valve of claim 1, wherein the first side of the rocker valve is positioned at an angle relative to a second side of the rocker valve, the angle between 5 and 40 degrees.

6. The rocker valve of claim 1, wherein the arm of the spring transitions between the first side of the rocker valve and a second side of the rocker valve via the number of rails based on a state of a regulator bag.

7. The rocker valve of claim 1, further comprising a second side of the rocker valve that abuts the first side, the first and second sides of the rocker valve sloping away from a ridgeline disposed between them.

8. The rocker valve of claim 1, wherein the pivot arms have a triangular cross-section taken along a length thereof.

9. The rocker valve of claim 1, further comprising a number of assist stops to prevent the arm of the spring from leaving the number of rails during assembly.

10. A system for regulating pressure inside a print head assembly, the system comprising:

a body of the print head assembly, the body forming a fluid chamber to house a number of components;

a lid, the lid attaching to an opening of the body such that the lid provides a seal to maintain the pressure inside the print head assembly; and the number of components to regulate pressure inside the print head assembly, the number of components comprising:

a regulator bag to inflate or deflate based on a pressure difference created relative to a location inside of the fluid chamber and a location outside of the fluid chamber;

a spring in contact with the regulator bag, the spring is compressed when the regulator bag is inflated and the spring is decompressed when the regulator bag is deflated;

a rocker valve to pivot, via pivot arms, between an open position and a closed position such that an arm of the spring transitions across the rocker valve to actuate the rocker valve; and a valve seat, the rocker valve to selectively engage with the valve seat based on the positions of the rocker valve to allow or prevent fluid from flowing into the fluid chamber of the body such that the pressure inside the print head assembly is regulated.

11. The system of claim 10, wherein the lid comprises:

a number of mounts to securely attach a first arm of the spring to the lid such that the first arm of the spring does not move when the spring is compressed or decompressed;

an opening to house the valve seat; and a number of pivot grooves to accommodate the pivot arms of the rocker valve such that the rocker valve pivots between the open positon and the closed position.

12. The system of claim 10, wherein the pressure difference is based on changes in temperature, atmospheric pressure, altitude, or combinations thereof.

13. The system of claim 10, wherein the regulator bag attaches to a chamber interface, the chamber interface providing access to the location outside of the fluid chamber such that the pressure difference is created.

14. The system of claim 10, wherein the spring comprises:

a bottom section of the spring, the bottom section in contact with the regulator bag such that the spring compresses and decompresses as the regulator bag inflates and deflates;

a first arm of the spring securely mounted to the lid; and a second arm of the spring transitionally mounted to the rocker valve via rails such that as the spring compresses and decompresses the second arm of the spring transitions between a first side of the rocker valve and a second side of the rocker valve to allow the rocker valve to pivot, via the pivot arms, between the open position and the closed position.

15. The system of claim 10, wherein the valve seat includes an opening such that when the rocker valve is in the open positon, the fluid flows through the opening and into the fluid chamber of the body to regulate the pressure inside the print head assembly; and wherein an orientation of the valve seat is such that the valve seat is compression fitted into the lid or the valve seat is a volcano orifice that is molded into the lid.

16. The system of claim 10, wherein the rocker valve comprising:

a number of rails to transitionally connect a second arm of the spring to the rocker valve;

a first side of the rocker valve to selectively engage with the valve seat based on a position of the second arm of the spring relative to the first side of the rocker valve;

a second side of the rocker valve located opposite to the first side; and the pivot arms to pivot the rocker valve between the closed position and the open position such that the first side selectively engages with the valve seat;

wherein the rocker valve pivots, via the pivot arms, to the closed position to prevent fluid to flow into the print head assembly when the second arm of the spring is in contact with the first side of the rocker valve; and wherein the rocker valve pivots, via the pivot arms, to the open position to allow fluid to flow into the print head assembly when the second arm of the spring is in contact with the second side of the rocker valve.

17. The system of claim 10, further comprising a number of retainer ribs to prevent the rocker valve form dislodging from pivot grooves in the lid.

18. A method for regulating pressure inside a print head assembly, the method comprising:

with a threshold pressure created relative to a location inside of a fluid chamber and a location outside of the fluid chamber, inflating a regulator bag such that as the regulator bag inflates the regulator bag compresses a spring such that a second arm of the spring transitionally attached to a rocker valve transitions from a first side of the rocker valve to a second side of the rocker valve to allow the rocker valve to transition from a closed position to an open position; and with the rocker valve in the open position, allowing fluid to flow into the fluid chamber to deflate the regulator bag such that as the regulator bag deflates the regulator bag decompresses the spring such that the second arm of the spring transitionally attached to the rocker valve transitions from the second side of the rocker valve to the first side of the rocker valve to allow the rocker valve to transition from the open position to the closed position.

19. The rocker valve of claim 1, further comprising a second arm of the spring abutting a surface within a fluid chamber of the print head assembly.

20. The rocker valve of claim 19, wherein the point of contact between the second arm of the spring and the surface within the fluid chamber does not move with respect to the surface.

* * * * *